US007287539B2

(12) United States Patent
Lee

(10) Patent No.: US 7,287,539 B2
(45) Date of Patent: Oct. 30, 2007

(54) BUMPER FOR AN UMBRELLA

(76) Inventor: Chia-Chen Lee, No. 6-1, Lane 497, Wuchuan S. Rd., Taichung (TW)

( * ) Notice: Subject to any disclaimer, the term of this patent is extended or adjusted under 35 U.S.C. 154(b) by 0 days.

(21) Appl. No.: 10/677,365

(22) Filed: Oct. 3, 2003

(65) Prior Publication Data

US 2005/0072452 A1 Apr. 7, 2005

(51) Int. Cl.
*A45B 25/06* (2006.01)

(52) U.S. Cl. ..... 135/28; 135/16; 135/37

(58) Field of Classification Search ..... 135/15.1, 135/16, 19, 23, 28, 37, 82; 248/188.9, 311.2
See application file for complete search history.

(56) References Cited

U.S. PATENT DOCUMENTS 2,063,216 A * 12/1936 Zaparka ..... 267/30
3,482,872 A * 12/1969 Chamberlain ..... 297/472
5,052,665 A * 10/1991 Sakuragi ..... 267/220
5,217,196 A * 6/1993 Morell ..... 248/314
5,253,666 A * 10/1993 Huang ..... 135/28
5,297,570 A * 3/1994 Conner ..... 135/16
6,264,153 B1 * 7/2001 Ragner et al. ..... 248/311.2
6,328,047 B1 * 12/2001 Lee ..... 135/20.1

FOREIGN PATENT DOCUMENTS

GB 2256133 A * 12/1992
GB 2359498 A * 8/2001

* cited by examiner

*Primary Examiner*—Winnie Yip
(74) *Attorney, Agent, or Firm*—Lowe Hauptman Ham & Berner, LLP

(57) ABSTRACT

A bumper for an umbrella is made of resilient material and is an undulating tube composed of a securing end (32), a serpentine middle portion (34), an abutting end (36) and a straight through hole (not numbered) defined through securing end (32), the serpentine middle portion (34) and the abutting end (36). The bumper is compressed at the serpentine middle portion (34) to damp the shock caused by bumping of a sliding ring.

2 Claims, 5 Drawing Sheets

BUMPER FOR AN UMBRELLA

BACKGROUND OF THE INVENTION

1. Field of the Invention

The invention relates to a bumper for an umbrella, and particularly a bumper secured on a shank of the umbrella to provide a shock-absorbing effect when the umbrella opens.

2. Description of Related Art

With reference to FIG. 4, a conventional umbrella is composed of a frame (50) and a canopy (60) mounted on the frame (50).

The frame (50) has a shank (52) with a top end, a sliding ring (54), a spreader (542), a stretcher (56), a rib set (58) and a ferrule (522). The sliding ring (54) is movably mounted on the shank (52) and has an enlarged round top (not numbered), a telescoping tube (not numbered) extending from the round top and a stretcher base (544) mounted on the telescoping tube. The spreader (542) is composed of multiple rods (not numbered) pivotally and radially formed around the enlarged round top of the sliding ring (54) The stretcher (56) is also composed of multiple rods (not numbered) pivotally and radially attached around the stretcher base (544) The rib set (58) is composed of multiple rods pivotally and radially attached at the top end of the shank (52) to support the canopy (60) Each rod of the stretcher (56) movably connects one corresponding rod of the spreader (542) at a middle portion of the spreader rod and further has a distal end to pivotally connect to one corresponding rod of the rib set (58) Additionally, multiple retractable tabs (not shown) are formed on the shank (52) to selectively locate the sliding ring (54) at an extending position or at a retracting position.

Moreover, a limiting tube (70) is mounted on the shank (52) and secured under the top end of the shank (52) to selectively abut the stretcher base (544) of the sliding ring (54). Whereby, the limiting tube (70) enables the sliding ring (54) to stop in a preferred position to fully extend the stretcher (56) and keep the umbrella open.

However, the limiting tube (70) is usually made of rigid plastic and easily broken when the sliding ring (54) bumps against the limiting tube (70) whereby the umbrella malfunctions and must be thrown away. This is especially so when the umbrella is automatically extended by means of securing a restituting spring (not shown) around the telescoping tube of the sliding ring (54). The restituting spring is compressed and the telescoping tube retracts into the sliding ring (54) when the umbrella is at the retracting position. When the tab locating the sliding ring (54) retracts, the sliding ring (54) is released and rapidly bumps the limiting tube (70), causing vibrations and damage to joints of the frame (10).

With reference to FIG. 5, to avoid the vibrations and damage caused by bumping, a spring (80) is mounted on the shank (52) between the top end of the shank (52) and the stretcher base (544) of the sliding ring (54). Although the spring (80) provides a shock absorbing effect to the umbrella, it is difficult to secure the spring (80) under the top end of the shank (52) whereby the spring (80) slides along the shank (52) when the sliding ring (54) does not abut against the spring (80). However, the spring (80) sliding on the shank (52) is easily trapped by the multiple tabs emerging out from the shank (52) such that the operation of the umbrella blocked and inconvenient.

The present invention has arisen to provide a bumper for an umbrella to overcome and obviate the drawbacks of the conventional umbrellas.

SUMMARY OF THE INVENTION

A first objective of the present invention is to provide a bumper for an umbrella that has an excellent shock-absorbing effect.

Further benefits and advantages of the present invention will become apparent after a careful reading of the detailed description in accordance with the drawings.

DETAILED DESCRIPTION OF THE PREFERRED EMBODIMENT

Figure 1:
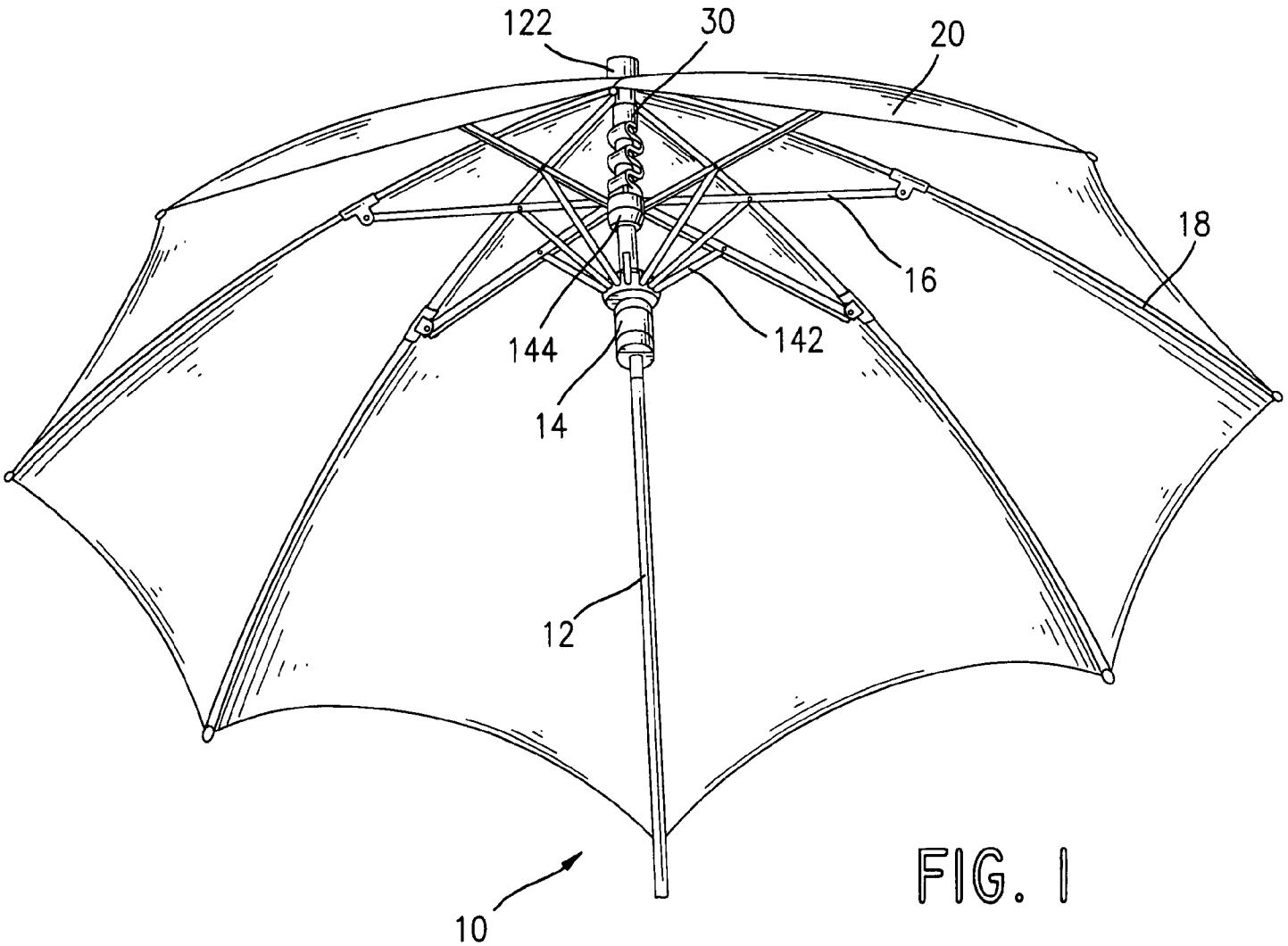
FIG. 1 is a perspective view of a bumper in accordance with the present invention, wherein the bumper is secured on a frame of an umbrella.

With reference to FIG. 1, a bumper (30) for an umbrella composed of a frame (10) and a canopy (20), which is adapted to secure on the frame (10) of the umbrella.

The frame (10) has a shank (12) with a top end, a sliding ring (14), a spreader (142), a stretcher (16), a rib set (18) and a ferrule (122). The sliding ring (14) is movably mounted on the shank (12) and has an enlarged round top (not numbered), a telescoping tube (not numbered) extending from the round top and a stretcher base (144) mounted on the telescoping tube. The spreader (142) is composed of multiple rods (not numbered) pivotally and radially formed around the enlarged round top of the sliding ring (14). The stretcher (16) is also composed of multiple rods (not numbered) pivotally and radially attached around the stretcher base (144). The rib set (18) is composed of multiple rods pivotally and radially attached at the top end of the shank (12) to support the canopy (20). Each rod of the stretcher (16) pivotally connects one corresponding rod of the spreader (142) at a middle portion and further has a distal end to pivotally connect to one corresponding rod of the rib set (18).

Figure 2:
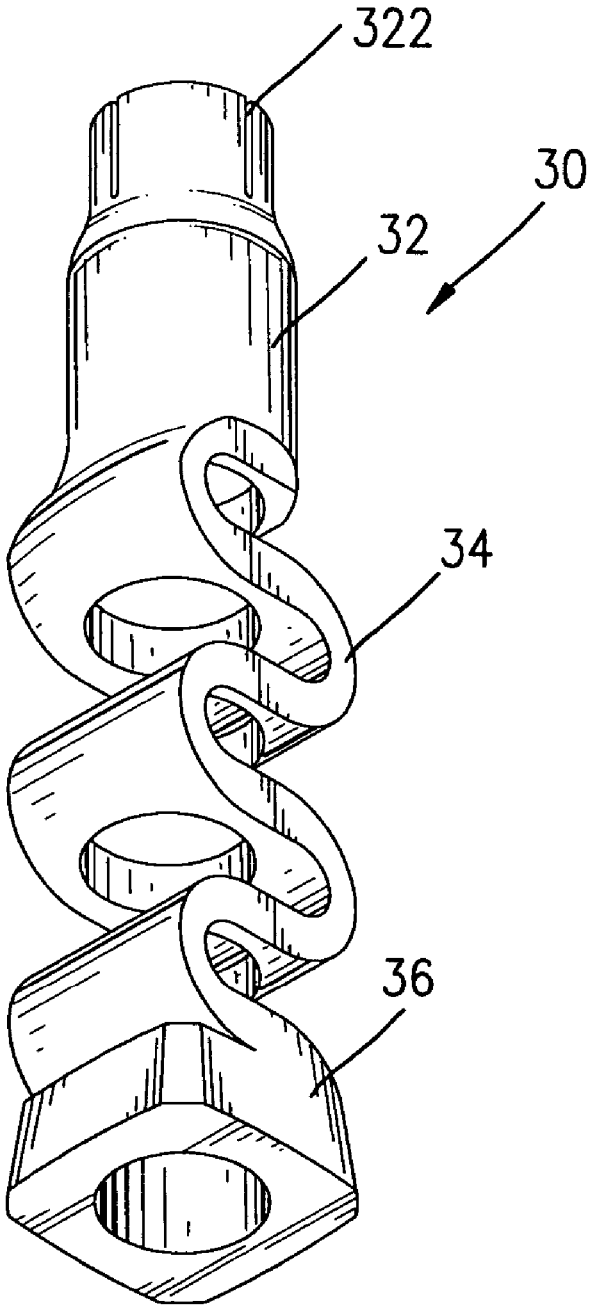
FIG. 2 is an enlarged perspective view of the bumper in FIG. 1.

With reference to FIG. 2, the bumper (30) is made of resilient material and shaped in a serpentine configuration. In FIG. 2, the bumper (30) is an undulating tube composed of a securing end (32), a serpentine middle portion (34), an abutting end (36) and a straight through hole (not numbered) defined through securing end (32), the serpentine middle portion (34) and the abutting end (36) The securing end (32) is adapted to secure under the top end of the shank (12) and further has a narrow distal edge to clamp on the shank (12) Multiple slits (322) are defined in the narrow distal edge to allow the narrow distal edge slightly expand when the bump (30) is secured under the top end of the shank (12). By clamping at the narrow distal end, the bumper (30) is securely attached under the top end of the shank (12) in position. The serpentine middle portion (34) is in the form of an undulating bar to make the bumper (30) have restitution spaces between two undulations. The abutting end (36) is adapted to abut on the stretcher base (144) and is shaped as a cubic block.

Figure 3:
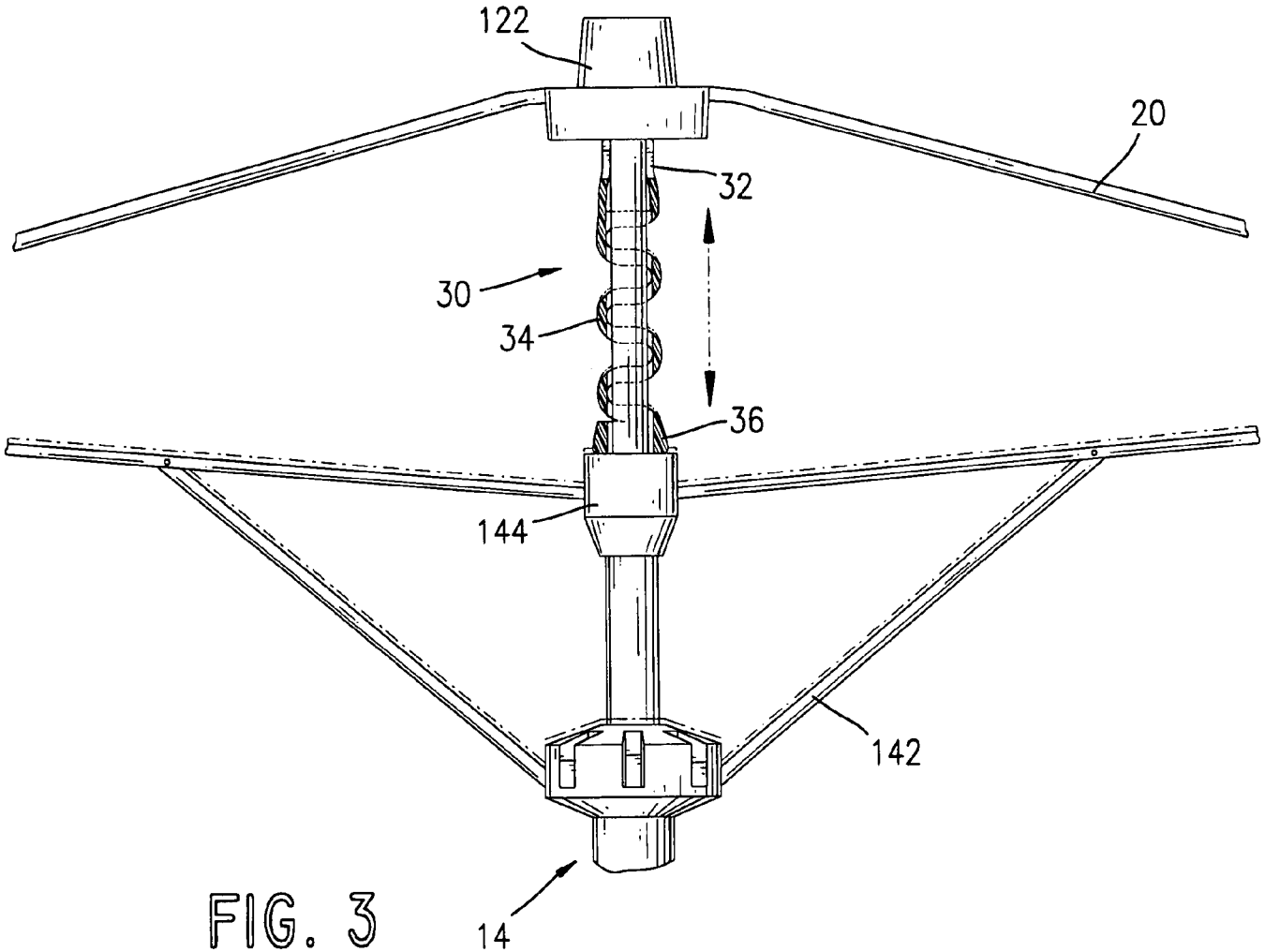
FIG. 3 is a partially enlarged cross-sectional side plane view of the bumper showing the shock-absorbing situation of the bumper.
Figure 4:
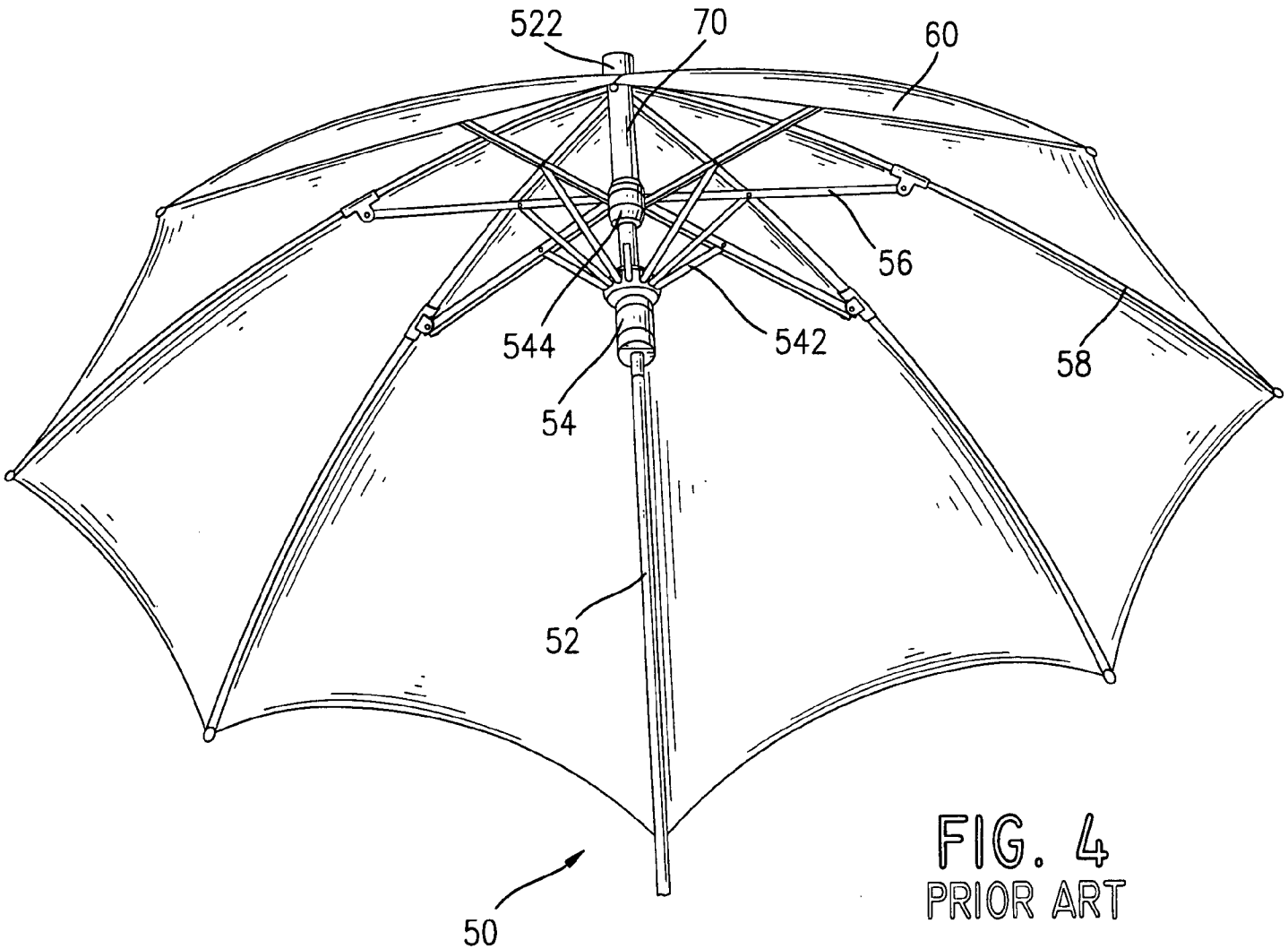
FIG. 4 PRIOR ART
FIG. 4 is a perspective view of a first embodiment of an umbrella in accordance with the prior art.
Figure 5:
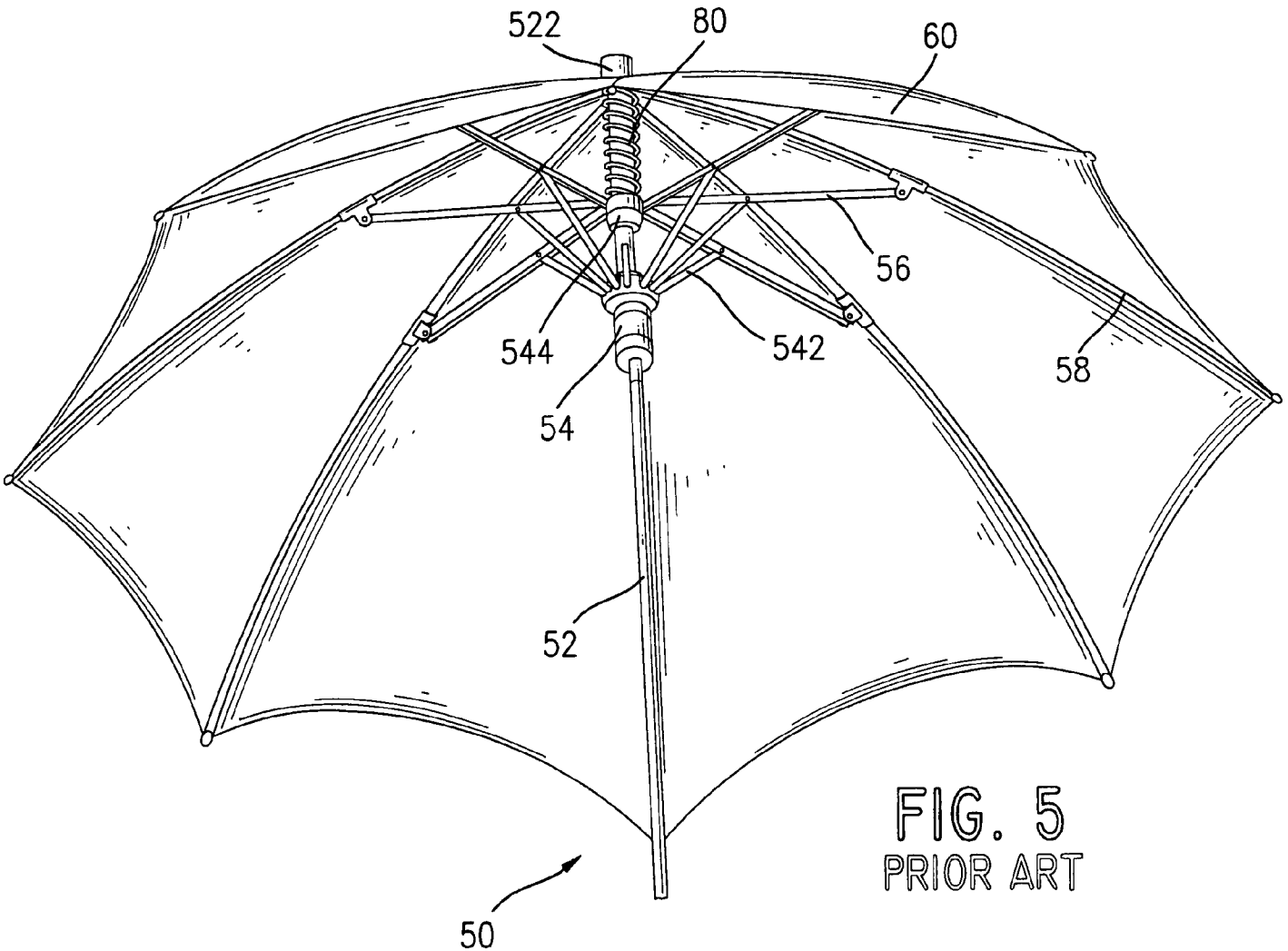
FIG. 5 PRIOR ART
FIG. 5 is a perspective view of a second embodiment of an umbrella in accordance with the prior art.

With reference to FIG. 3, when the sliding ring (14) bumps the abutting end (36) of the bumper (30), the serpentine middle section (34) is slightly compressed to damp the shock. Therefore, the vibration and the damage to the frame (10) of the umbrella can be minimized to a non-damaging magnitude.

According to the above description, the bumper (30) is securely mounted under the top end of the shank (12) to avoid the bumper (30) sliding on the shank (12) and trapped by the tabs. Additionally, the bumper (30) is enabled to be compressed at the serpentine middle portion (34) to damp the shock caused by bumping of the sliding ring (32). Therefore, malfunction and damage to the umbrella are avoided.

Although the invention has been explained in relation to its preferred embodiment, many other possible modifications and variations can be made without departing from the spirit and scope of the invention as hereinafter claimed.

What is claimed is:

1. A bumper for an umbrella having a shank with a top end and a sliding ring mounted on the shank, the bumper made of resilient material and comprising:

a securing end adapted to be secure under the top end of the shank and having a narrow distal edge and multiple slits defined in the narrow distal edge of the secured end;

a serpentine middle portion formed adjacent to the securing end and operationally compressed to provide shock-absorbing effect;

an abutting end formed adjacent to the serpentine middle portion and adapted to operationally stop the sliding ring; and a straight through hole defined through the securing end, the serpentine middle portion and the abutting end for extension of the shank.

2. The bumper for an umbrella as claimed in claim 1, wherein the abutting end is shaped as a cubic block.

* * * * *